US011708799B1

(12) United States Patent
Phan et al.

(10) Patent No.: US 11,708,799 B1
(45) Date of Patent: Jul. 25, 2023

(54) SYSTEM AND METHOD FOR PRODUCING HYDROGEN GAS TO SUPPLY INTERNAL COMBUSTION ENGINES

(71) Applicant: Hong Hue Nguyen, Sydney (AU)

(72) Inventors: Hai Ngoc Phan, Ho Chi Minh (VN); Hong Hue Nguyen, Sydney (AU)

(73) Assignee: Hong Hue Nguyen, Sydney (AU)

( * ) Notice: Subject to any disclaimer, the term of this patent is extended or adjusted under 35 U.S.C. 154(b) by 0 days.

(21) Appl. No.: 17/807,143

(22) Filed: Jun. 16, 2022

(51) Int. Cl.

| | |
|---|---|
| ***F02D 41/00*** | (2006.01) |
| ***F02D 41/32*** | (2006.01) |
| ***F02M 21/02*** | (2006.01) |
| *F02D 41/14* | (2006.01) |

(52) U.S. Cl.
CPC ..... *F02D 41/0027* (2013.01); *F02D 41/32* (2013.01); *F02M 21/0206* (2013.01); *F02M 21/0227* (2013.01); *F02D 2041/147* (2013.01)

(58) Field of Classification Search
CPC ..... F02D 41/0027; F02D 41/32; F02D 2041/147; F02M 21/0206; F02M 21/0227
See application file for complete search history.

(56) References Cited

U.S. PATENT DOCUMENTS

| | | | | |
|---|---|---|---|---|
| 4,750,453 | A * | 6/1988 | Valdespino | F02B 43/10 123/3 |
| 2008/0133109 | A1* | 6/2008 | Carlson | B60L 1/003 29/888.011 |
| 2010/0012090 | A1* | 1/2010 | Lewis, III | F02B 43/10 123/3 |
| 2019/0017448 | A1* | 1/2019 | Monros | F02B 43/12 |

FOREIGN PATENT DOCUMENTS

| | | | | |
|---|---|---|---|---|
| WO | WO-2016054371 | A1 * | 4/2016 | C25B 15/02 |
| WO | WO-2019008781 | A1 * | 1/2019 | |
| WO | WO-2019082403 | A1 * | 5/2019 | |

* cited by examiner

*Primary Examiner* — Joseph J Dallo

(57) ABSTRACT

The present invention is to provide a system for producing hydrogen gas to supply internal combustion engines, comprising a controller, an internal combustion engine, an electric system of transportation vehicle, a fuel supply unit, an exhaust sensor, a battery management system, and an electrolysis system. The system saves fuel, almost completely reduces the number of harmful emissions released into the environment, cools the internal combustion engine, and clears residue inside the internal combustion engine. In addition, the invention also provides a method for producing hydrogen gas to supply internal combustion engines.

5 Claims, 6 Drawing Sheets

SYSTEM AND METHOD FOR PRODUCING HYDROGEN GAS TO SUPPLY INTERNAL COMBUSTION ENGINES

FIELD OF THE INVENTION

The present invention relates to hydrogen gas generation devices. More particularly, the present invention relates to a system and method for producing hydrogen gas to supply internal combustion engines, which saves fuel and reduces emissions to the environment.

BACKGROUND ART

Currently, the problem of air pollution is one of the serious problems that seriously affect human life. In particular, emissions from the internal combustion engines of the vehicle are one of the main causes of air pollution. During operation, the vehicle's internal combustion engine will generate toxic gasses such as $NO_x$, CO, $CO_2$, $SO_2$, $C_mH_n$, etc. it is these substances that pollute the environment and affect human health.

Along with the growth in the number of vehicles, the amount of diesel and gasoline fuels used for the internal combustion engines of vehicles has also increased rapidly. Many studies are conducted to find other fuels to gradually replace or reduce the use of diesel and gasoline fuels for internal combustion engines of vehicles. In particular, hydrogen gas is directed to be a safe and effective solution, helping to reduce emissions into the environment.

In the world, there are many hydrogen gas generation systems from water by electrolysis to supply the internal combustion engines of the vehicle, but these systems have not yet brought high efficiency.

Patent application U.S. Pat. No. 6,257,175B1, discloses a oxygen and hydrogen generator apparatus for internal combustion engines, comprising a hydrogen and oxygen generator apparatus, a battery, a water reservoir, an engine. Only an anode and a cathode are illustrated within the apparatus, an oxygen collector is disposed about and above the anode, a hydrogen collector is disposed above and about the cathode, a float switch to assist in controlling the water level inside the hydrogen and oxygen generator apparatus. The anode and the cathode are powered by the battery. The battery is connected to an ignition switch to ensure that oxygen and hydrogen are generated only when the circuit is energized. The engine comprises an intake manifold, and a fuel injection unit. The intake manifold supplies air to the engine. The fuel supply unit supplies fuel to the engine. An oxygen conduit extends from the collector to the intake manifold. A hydrogen conduit extends from the collector to the fuel injection unit.

Patent application US20140216366A1, discloses a Hydrogen on-demand fuel system for internal combustion engines, comprising a microcontroller, an engine, a PCV valve, and an oxy-hydrogen generator. The microcontroller connected to sensors to monitor the operation of the car. The sensors include an engine temperature sensor, a spark plug sensor, a battery sensor, a PCV valve sensor, and engine RPM sensor, an accelerometer sensor, and an exhaust sensor. The engine is connected to an intake manifold. When operating, the intake manifold will receive a mixture of fuel and air to enter a combustion chamber. After combustion, the residual fuel and air mixture is returned to the intake manifold for reuse. The oxy-hydrogen generator consists of metal plates that serve as an anode and a cathode. The metals include zinc, cadmium, gold, platinum, palladium, and the like. The anode and cathode are supplied with power from the power supply of the engine or the battery. The oxy-hydrogen generator also includes an outlet that delivers oxy-hydrogen to the intake manifold. The oxy-hydrogen generator can be connected to a reservoir bubbler that provides the electrolyte solution.

Patent application U.S. Pat. No. 8,454,808B2, discloses a hydrogen supplemental system for on-demand hydrogen generation for internal combustion engines, comprising a portable hydrogen supplemental system, an internal combustion engine, a vehicle battery, and a control circuit. The vehicle battery provides power for the portable hydrogen supplemental system. After power is supplied to the portable hydrogen supplemental system, the generated hydrogen is sent to an intake of the internal combustion engine. Oxygen is released into the environment or into the internal combustion engine. The portable hydrogen supplemental system comprising a housing unit, inside the housing unit are a electrolysis device and a nonelectrolyte water tank positioned above the electrolysis device arranged in such a manner as to supply nonelectrolyte water to the electrolysis device. The electrolysis device comprising an anode, a cathode, electrocatalysts and disposed respectively on the anode and the cathode, and a membrane disposed between the electrocatalysts. The nonelectrolyte water enters the electrolysis device producing hydrogen and oxygen. The hydrogen and oxygen are re-introduced into a hydrogen section and an oxygen section of the nonelectrolyte water tank. The hydrogen in the hydrogen section will be sent to an air intake of the internal combustion engine. The control circuit comprises a vacuum switch, an operator controlled switch, a global positioning system (GPS), AND gate, and a switch. The operator controlled switch which completes the electrical circuit to the portable hydrogen supplemental system when the engine is running.

It can be seen that the above inventions meet their specific purposes and requirements, however they do not use an electrolysis system that can electrolyze distilled water to produce hydrogen for an internal combustion engine without the use of a catalyst. On the other hand, the above inventions do not cover the electrical circuits and methods of generating steady current to both supply alternating current to the system, and to give feedback to recharge the original priming battery module.

Therefore, it is essential to design a hydrogen gas generation system to supply internal combustion engines which saves fuel, almost completely reduces the number of harmful emissions released into the environment, cools the internal combustion engines, and clears residue inside internal combustion engines.

It is also necessary to design the electrical circuits and methods of generating steady current to both supply alternating current to the system, and to give feedback to recharge the original priming battery module.

It is also necessary to design an electrolysis system that can electrolyze distilled water to produce clean hydrogen gas for an internal combustion engine without the use of a catalyst.

The system disclosed in the present invention solves the above described problems.

SUMMARY OF THE INVENTION

The main purpose of the invention is to provide a system for producing hydrogen gas to supply internal combustion engines, comprising a controller, an internal combustion engine, an electric system of transportation vehicle, a fuel supply unit, an exhaust sensor, a battery management system, and an electrolysis system;

the electric system of transportation vehicle supplies current to the electrolysis system, the internal combustion engine, and other accessories of a transportation vehicle;

the fuel supply unit supplies fuel to the internal combustion engine;

the exhaust sensor is installed in the exhaust pipe of the transportation vehicle, helps to measure the amount of residual fuel in the exhaust gas emitted from the internal combustion engine, and then sends it to the controller, thereby the controller will adjust the fuel supply unit to inject a suitable amount of fuel for the internal combustion engine;

the battery management system is used to supply current to the electrolysis system to carry out the electrolysis process;

the battery management system comprising at least one battery, a second current-regulating circuit, a solenoid motor, a generator, an amplifier circuit, and a rectifier circuit;

the battery is used to supply a direct current to the second current-regulating circuit;

the second current-regulating circuit is connected to the battery, used to convert the direct current into alternating current by i increasing the amplitude value large enough and generating the appropriate frequency;

the second current-regulating circuit will provide the alternating current that rotates the solenoid motor to generate electromagnetic induction; by the effect of the electromagnetic field, the generator will be activated and generate a constant voltage alternating current;

the amplifier circuit is connected to the generator, used to increase the amplitude of voltage, power and amperage of the alternating current to a level suitable;

the rectifier circuit is connected to the amplifier circuit, used to convert the alternating current into a direct current to supply the electrolysis system, other components of the transportation vehicle, and the battery;

the electrolysis system is supplied with electricity from the electric system of transportation vehicle or/and a battery management system to perform the electrolysis process, generating the clean hydrogen gas for the internal combustion engine of the transportation vehicle;

the electrolysis system comprising an electrolysis device, a hydrogen filter device, and a first current-regulating circuit;

the first current-regulating circuit is connected to the electric system of transportation vehicle or/and the battery management system, used to convert the direct current into alternating current by increasing the amplitude value large enough and generating the appropriate frequency to supply the electrolysis device;

the electrolysis device comprising an input, metal bars, an output, and diaphragms; wherein the input is connected to a water box; the metal bars are connected to the first current-regulating circuit, made of stainless steel and supplied with amperage I from 1 A to 20 A; the output is connected to the hydrogen filter device; the diaphragm is made of graphene or composite plastic;

the hydrogen filter device is used to increase the purity and reduce the temperature of the hydrogen gas stream; comprising a top part, body part, and bottom part; wherein the bottom part is connected to the output of the electrolysis device, the body part is used to hold some amount of water, and the top part is connected to the intake manifold of the internal combustion engine;

the internal combustion engine has an intake manifold used to collect outside air into a cylinder of the internal combustion engine; the intake manifold is also connected to the electrolysis system to receive the hydrogen gas supplied to the cylinder; an exhaust line of the internal combustion engine will bring the emissions from inside the cylinder to the exhaust pipe and discharged into the environment;

the controller contains control circuits used to control the water box, the internal combustion engine, the electric system of transportation vehicle, the fuel supply unit, the battery management system, the exhaust sensor, the electrolysis device, the hydrogen filter device, the first current-regulating circuit, and other devices of the transportation vehicle.

The other purpose of the invention is to provide a method for producing hydrogen gas to supply internal combustion engines, said method including the following steps:

i) supplying the electrolysis system and the battery management system, and then connecting them to the rest of the hydrogen gas generation system to supply internal combustion engines;

ii) setting the amount of hydrogen supplied to the internal combustion engine through the screen;

iii) starting the internal combustion engine: the controller controls the electric system of transportation vehicle to supply the current to the internal combustion engine, and at the same time controls the fuel supply unit to inject the fuel into the cylinder, air will also be introduced to the cylinder through the intake manifold;

iv) supplying current to the electrolysis system: the electric system of transportation vehicle and/or the battery management system supply current to the first current-regulating circuit, the first current-regulating circuit convert the direct current into alternating current by increasing the amplitude value large enough and generating the appropriate frequency to supply the metal bars of the electrolysis device; the current supplied to the metal bars to perform the electrolysis process is from 1 A to 20 A;

v) performing the electrolysis process: when the metal bars are supplied with electricity, they will perform the electrolysis of the water inside the electrolysis device to produce the hydrogen gas, the hydrogen gas is led through the output to the bottom part of the hydrogen filter device, then the hydrogen gas will pass through the water contained in the body part, where the hydrogen will be cleaned and reduce the temperature to temperature appropriate;

vi) supplying the clean hydrogen gas from the electrolytic system to the cylinder of the internal combustion engine;

vii) measuring the amount of fuel left in the emissions coming out of the exhaust pipe, then sending the results to the controller: if the amount of fuel left in the emissions exceeds the preset allowable threshold, the controller will issue a warning on the screen for the operator to adjust the amount of the fuel supplied to the internal combustion engine from the fuel supply unit.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE INVENTION

References will now be made in detail to the invention, examples of which are illustrated in the accompanying drawings. The invention is intended to cover alternatives, modifications and equivalents, which may be included within the spirit and scope of the invention as defined by the appended claims. In the following detailed description of the present invention, numerous specific details are set forth in order to provide a thorough understanding of the present invention. However, it would be obvious to one of ordinary skills in the art at the time of invention, it may be practiced without these specific details. In other instances, well-known methods, procedures, components, and circuits have not been described in detail so as not to unnecessarily obscure aspects of the present invention.

Figure 1:
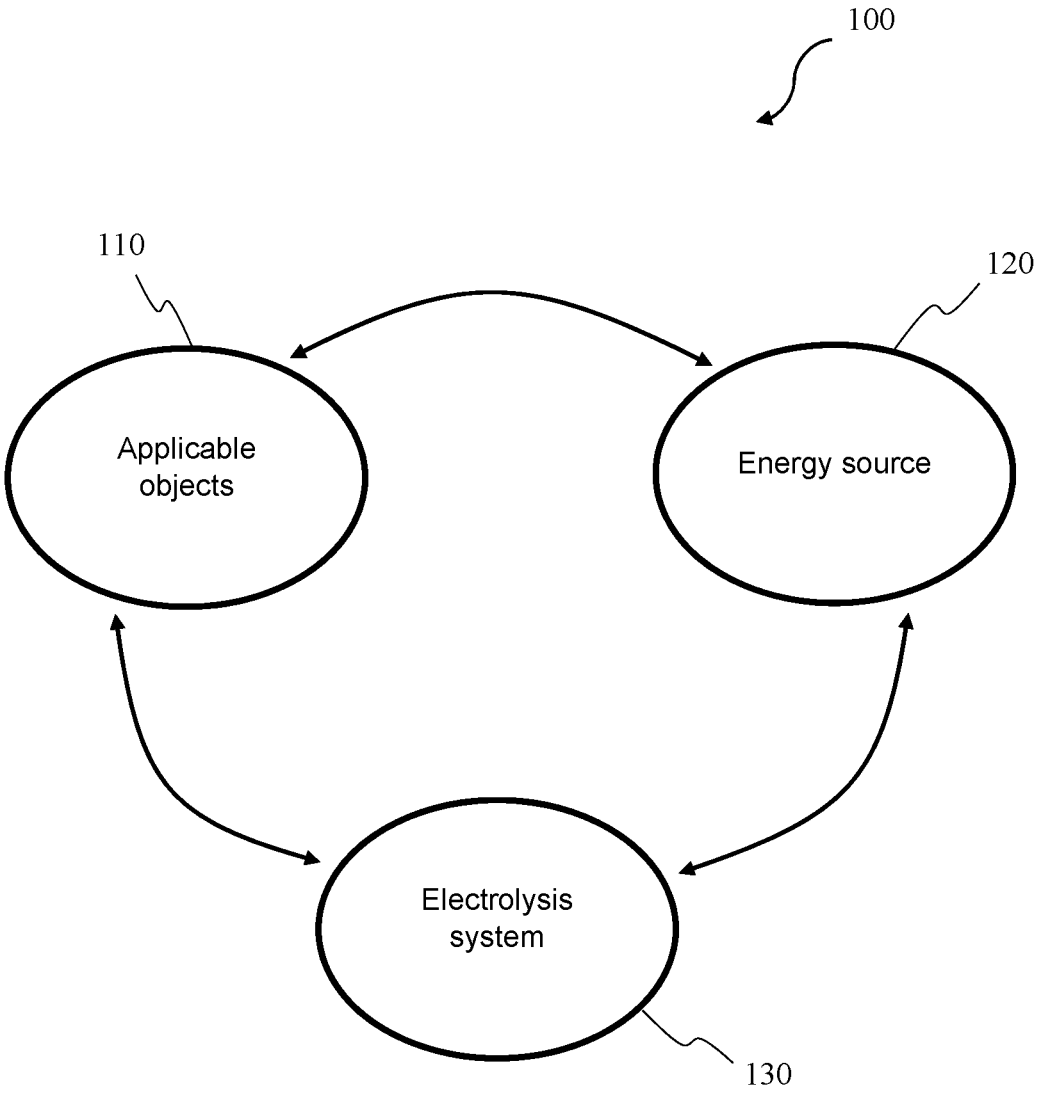
FIG. 1 illustrating a hydrogen gas generation system.

Referring to FIG. 1, a block diagram illustrating a hydrogen gas generation system 100 in accordance with the invention. The hydrogen gas generation system 100 comprising an applicable objects 110, an energy sources 120, and an electrolysis system 130, all of which are interconnected; wherein, the electrolysis system 130 is supplied with electrical energy from the energy sources 120 to perform the electrolysis process, products obtained from electrolysis process are brought to the applicable objects 110 for use. The applicable objects 110 comprising transportation vehicles, houses, factories, etc. The energy sources 120 comprising battery management system, electrical system of the applicable objects 110, or electrical system of other objects.

Figure 2:
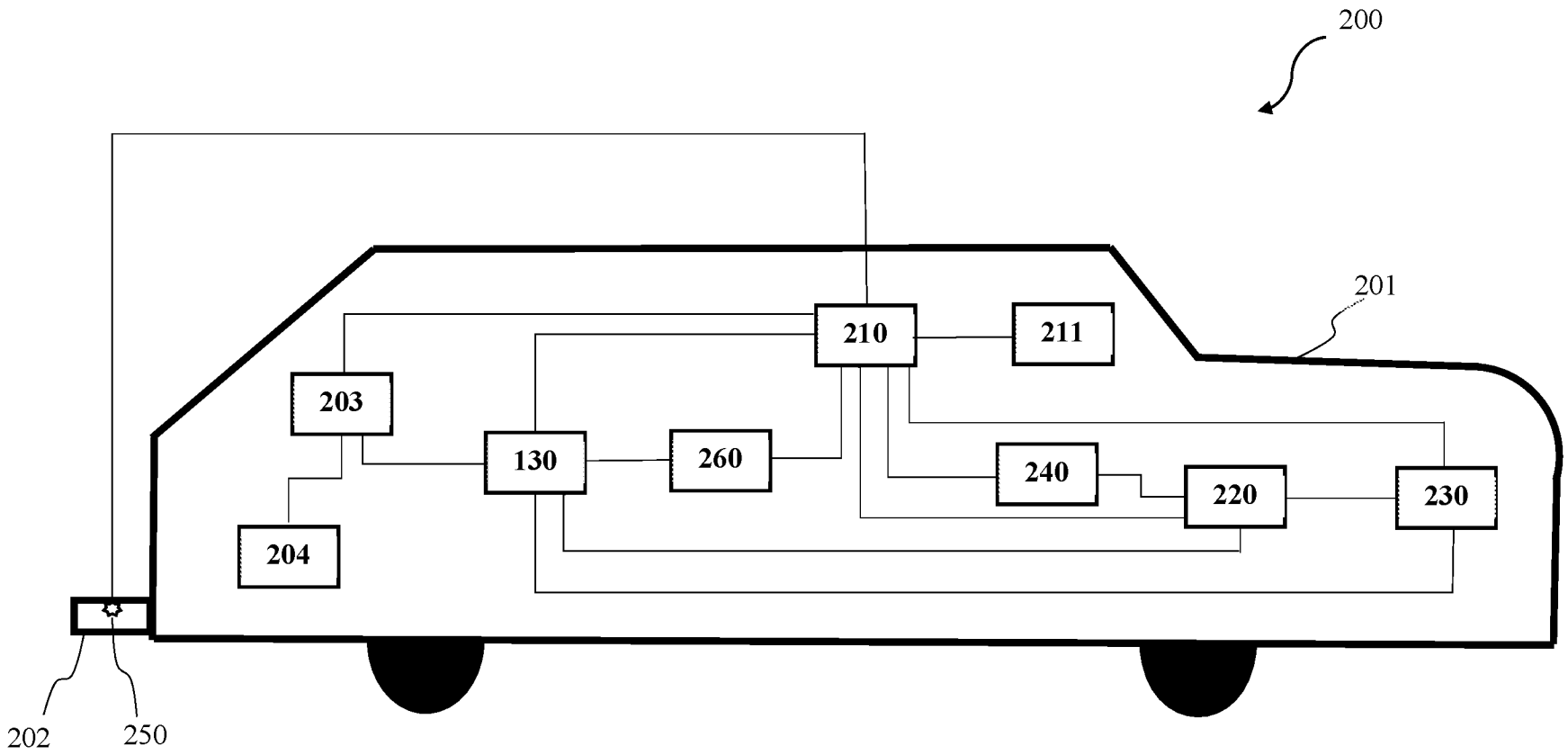
FIG. 2 illustrating a hydrogen gas generation system to supply internal combustion engines.

Referring to FIG. 2, a block diagram illustrating a hydrogen gas generation system to supply internal combustion engines 200 in accordance with an exemplary embodiment of the present invention. The hydrogen gas generation system to supply internal combustion engines 200 comprising a controller 210, an internal combustion engine 220, an electric system of transportation vehicle 230, a fuel supply unit 240, an exhaust sensor 250, and the electrolysis system 130.

The electrolysis system 130 is supplied with electricity from the electric system of transportation vehicle 230 to perform the electrolysis process, generating the clean hydrogen gas for the internal combustion engine 220 of a transportation vehicle 201. A water box 203 is connected to the electrolysis system 130, which supplies the water used for electrolysis to the electrolysis system 130. The water used for electrolysis comprising but is not limited to all types of water such as domestic water, pure water, distilled water, deionized water, etc. The water introduced into the water box 203 can be water generated from the air conditioning system 204 of the transportation vehicle 201 or water entered by the operator.

The electric system of transportation vehicle 230 supplies current to the electrolysis system 130, the internal combustion engine 220, and other accessories (not shown) of the transportation vehicle 201. The fuel supply unit 240 supplies fuel to the internal combustion engine 220. The fuel used is gasoline or diesel depending on type of the internal combustion engine 220 used.

The exhaust sensor 250 is installed in the exhaust pipe 202 of the transportation vehicle 201, helps to measure the amount of residual fuel in the exhaust gas emitted from the internal combustion engine 220, and then sends it to the controller 210. Thereby, the controller 210 will adjust the fuel supply unit 240 to inject a suitable amount of fuel for the internal combustion engine 220.

According to an embodiment of the present invention, the hydrogen gas generation system to supply internal combustion engines 200 further comprising a battery management system 260 is used to supply current to the electrolysis system 130 to carry out the electrolysis process.

The controller 210 contains control circuits used to control the electrolysis system 130, the water box 203, the internal combustion engine 220, the electric system of transportation vehicle 230, the fuel supply unit 240, the battery management system 260, the exhaust sensor 250, and other devices (not shown) of the transportation vehicle 201. A screen 211 is connected to the controller 210, which is used to display parameters such as the amount of hydrogen gas and fuel supply to the internal combustion engine 220, the amount of residual fuel present in the emissions, etc, enable the operator to monitor the entire operation of the vehicle 201; at the same time the operator can set the amount of hydrogen gas and fuel supply to the internal combustion engine 220, etc, through this the screen 211.

Figure 3:
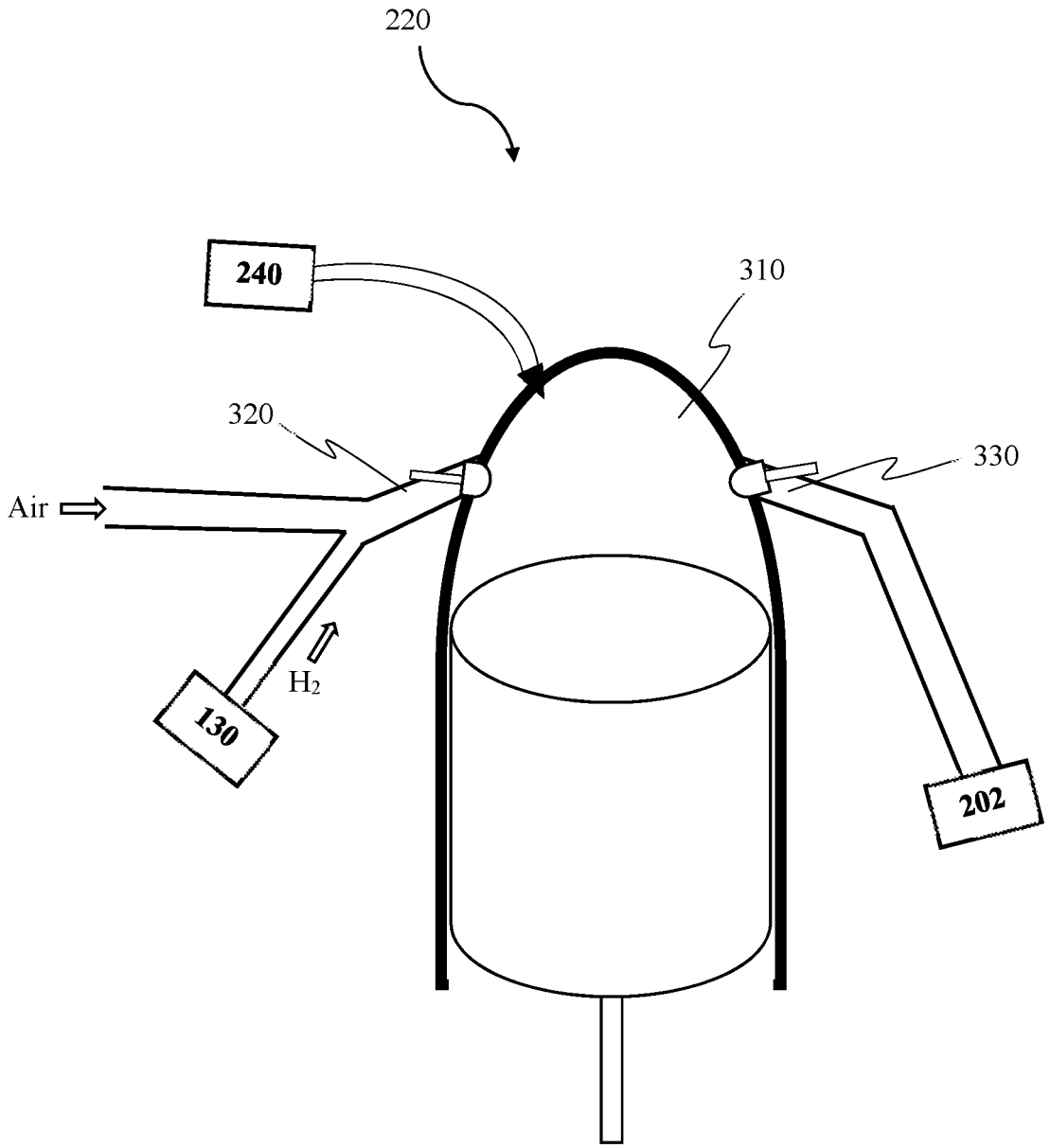
FIG. 3 illustrating the ingredients provided for the internal combustion engine.

Referring to FIG. 3, an illustrating the ingredients provided for the internal combustion engine 220 in accordance with an exemplary embodiment of the present invention. The internal combustion engine 220 has an intake manifold 320 used to collect outside air into a cylinder 310 of the internal combustion engine 220. The intake manifold 320 is also connected to the electrolysis system 130 to receive the clean hydrogen gas supplied to the cylinder 310. An exhaust line 330 of the internal combustion engine 220 will bring the emissions from inside the cylinder 310 to the exhaust pipe 202 and be discharged into the environment. When the internal combustion engine 220 is operating, the fuel supply unit 240 will inject fuel into the cylinder 310, then air and clean hydrogen gas are respectively introduced into the cylinder 310 of the internal combustion engine 220 through the intake manifold 320. The mixture of air, clean hydrogen gas and fuel are burned inside the cylinder 310 to produce the emissions, which will be taken out of the cylinder 310 through the exhaust line 330 and into the environment. On the other hand, when the clean hydrogen gas is introduced into the cylinder 310, it also eliminates harmful gasses such as $NO_x$, CO, $CO_2$, $SO_2$, $C_nH_m$, etc. thus purging the exhaust stream coming out of the cylinder 310.

Figure 4:
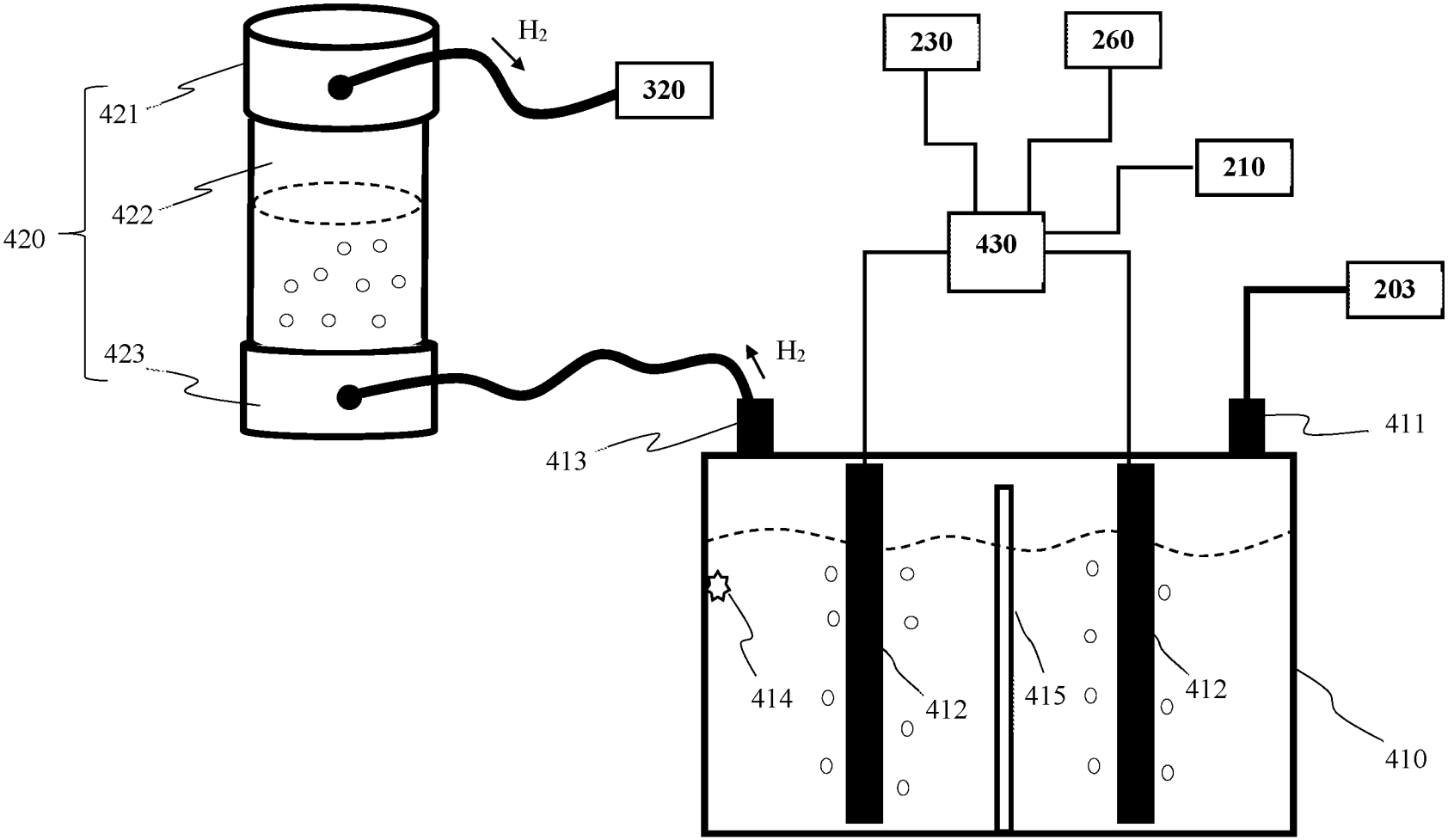
FIG. 4 illustrating the construction of the electrolysis system.

Referring to FIG. 4, illustrating the construction of the electrolysis system 130 in accordance with an exemplary embodiment of the present invention. The electrolysis system 130 comprises an electrolysis device 410, a hydrogen filter device 420, and a first current-regulating circuit 430, all connected to the controller 210. The first current-regulating circuit 430 is connected to the electric system of transportation vehicle 230 or/and the battery management system 260, used to convert the direct current into alternating current by increasing the amplitude value large enough and generating the appropriate frequency to supply the electrolysis device 410. Thanks to the first current-regulating circuit 430, the electrolysis device 410 is able to electrolyze distilled water without the use of a catalyst.

The electrolysis device 410 comprises an input 411, metal bars 412, an output 413, and diaphragms 415. The input 411 is connected to the water box 203. The metal bars 412 are connected to the first current-regulating circuit 430, used to conduct electricity through water to perform the electrolysis process of water molecules into hydrogen. The metal bars 412 can consist of any known metal or alloy, the best is stainless steel. The output 413 is connected to the hydrogen filter device 420. The diaphragm 415 is made of graphene or composite plastic. Wherein, the current supplied to the metal bars 412 to perform the electrolysis process is from 1 A to 20 A.

The hydrogen filter device 420 is used to increase the purity and reduce the temperature of the hydrogen gas stream, comprising a top part 421, body part 422, and bottom part 423; wherein, the bottom part 423 is connected to the output 413 of the electrolysis device 410, the body part 422 is used to hold some amount of water, and top part 421 is connected to the intake manifold 320 of the internal combustion engine 220.

As shown in FIG. 4, a water level sensor 414 is installed in the electrolysis device 410 and connected to the controller 210, which is used to determine the water level inside the electrolysis device 410. When the water level inside the electrolysis device 410 drops below the predetermined threshold, the water level sensor 414 will send a signal to the controller 210, then the controller 210 will control the water box 203 to put the water into the electrolysis device 410. When the water introduced inside the electrolysis device 410 reaches the predetermined highest threshold, the water level sensor 414 sends a signal to the controller 210 to control the water box 203 to stop supplying the water for the electrolysis device 410.

When the metal bars 412 are supplied with electricity from the first current-regulating circuit 430, they will perform the electrolysis of the water inside the electrolysis device 410 to produce the hydrogen gas. This the hydrogen gas is led through the output 413 to the bottom part 423 of the hydrogen filter device 420, then the hydrogen gas will pass through the water contained in the body part 422, where the hydrogen will be cleaned and reduce the temperature to temperature appropriate, the hydrogen gas eventually goes up the top part 421 and into the intake manifold 320 of the internal combustion engine 220.

Figure 5A:
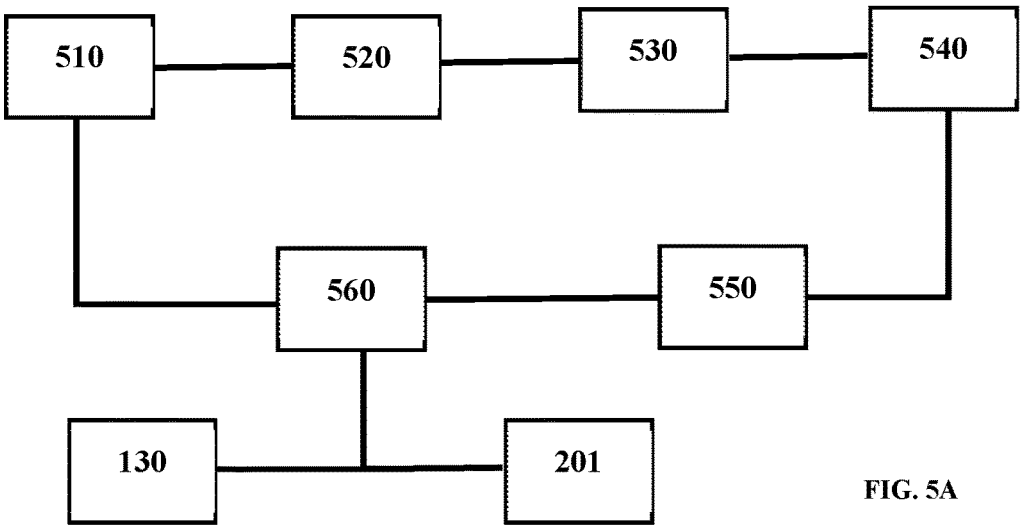
FIG. 5A illustrating the battery management system.
Figure 5B:
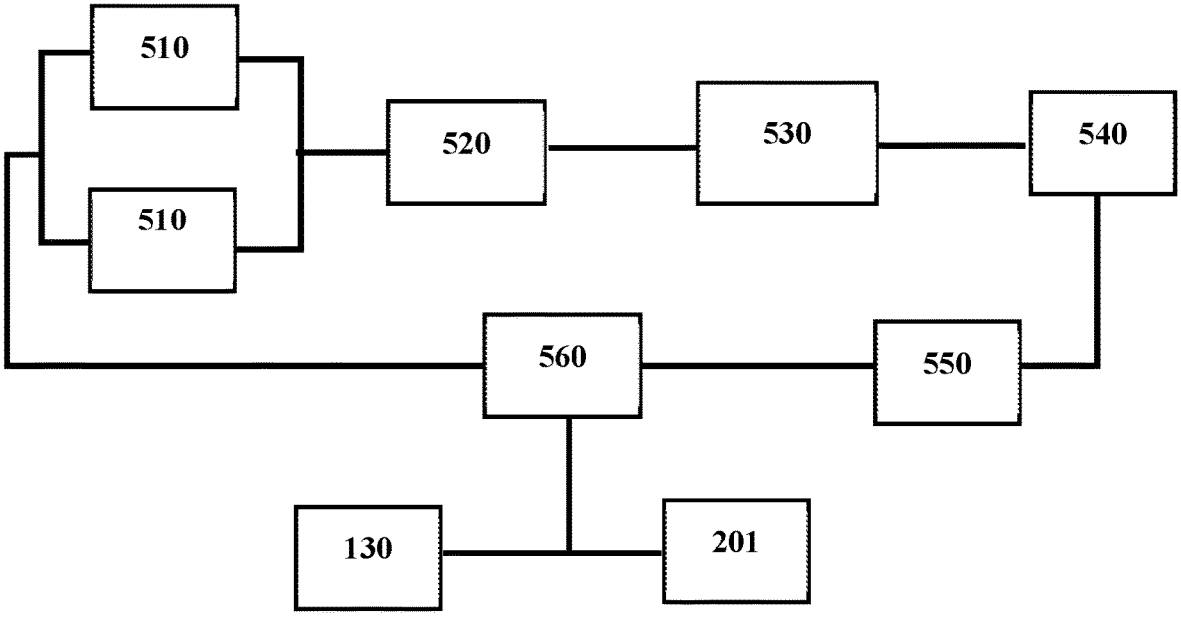
FIG. 5B illustrating the battery management system under another embodiment of the invention.

Referring to FIG. 5A and FIG. 5B, illustrating the battery management system 260 in accordance with an exemplary embodiment of the present invention. The battery management system 260 comprising a battery 510, a second current-regulating circuit 520, a solenoid motor 530, a generator 540, an amplifier circuit 550, and a rectifier circuit 560, all are connected together. The battery 510 is used to supply a direct current to the second current-regulating circuit 520. According to the embodiment of the invention, the battery 510 provides a direct current from 12 to 24 volts. The second current-regulating circuit 520 is used to convert the direct current into alternating current by increasing the amplitude value large enough and generating the appropriate frequency. The second current-regulating circuit 520 will provide the alternating current that rotates the solenoid motor 530 to generate electromagnetic induction. At this time, by the effect of the electromagnetic field, the generator 540 will be activated and generate a constant voltage alternating current (according to the mechanism of conversion of mechanical energy to electrical energy). This alternating current is then passed through the amplifier circuit 550 to increase the amplitude of voltage, power and amperage of the alternating current to a level suitable. Next, the output alternating current from the amplifier circuit 550 is led to the rectifier circuit 560. The rectifier circuit 560 will convert the alternating current into a direct current to supply the electrolysis system 130 and other components of the transportation vehicle 201. In addition, a part of the current coming out of the rectifier circuit 560 is used to charge the battery 510. Thus, during operation, the battery management system 260 provides both an electrical power source for the electrolysis system 130 and other accessories of the transportation vehicle 201, and has feedback capability to automatically charge the input to the battery 510. According to an embodiment of the invention, the battery management system 260 may also include two or more batteries 510, all are connected together.

According to the invention, the first current-regulating circuit 430 and the second current-regulating circuit 520 operate on the basis of Pulse Width Modulation method (PWM). This is a method of pulse width adjustment of the trigger current, or in other words, a modulation method based on the variation of the width of the string contour and the density change over frequency adjusted in time. When using the PWM method, the current signal changes with the same frequency and different widths of the positive or negative side. This is the method made according to the principle of switching on and off the source of the load periodically according to the rule of adjusting the opening/closing time of the switch. The on/off agent is performed by semiconductor transistors included in the first current-regulating circuit 430 and the second current-regulating circuit 520. Specifically, when this switch is open, the entire voltage is applied to the load. When the switch is closed, the load is cut off from the voltage source. When the switch is closed, the load cuts off the voltage source. Therefore, during this switch on/off cycle, the load will sometimes receive the full voltage source, sometimes receive a part of it, and sometimes receive nothing at all. The effective value of the output voltage is calculated on the formula:

$$U_d = U_{max} \times (t_1/T) \text{ (Volt)}$$

wherein: $t_1/T$—this is the PWM correction factor, in %.

During the operation of the transportation vehicle 201, some water will be generated from the air conditioning system 204 of the transportation vehicle 201 and supplied to the water box 203. As a result, the electrolysis device 410 will be able to be supplied with the water to perform the electrolysis process without the operator having to replenish the water box 203.

Figure 6:
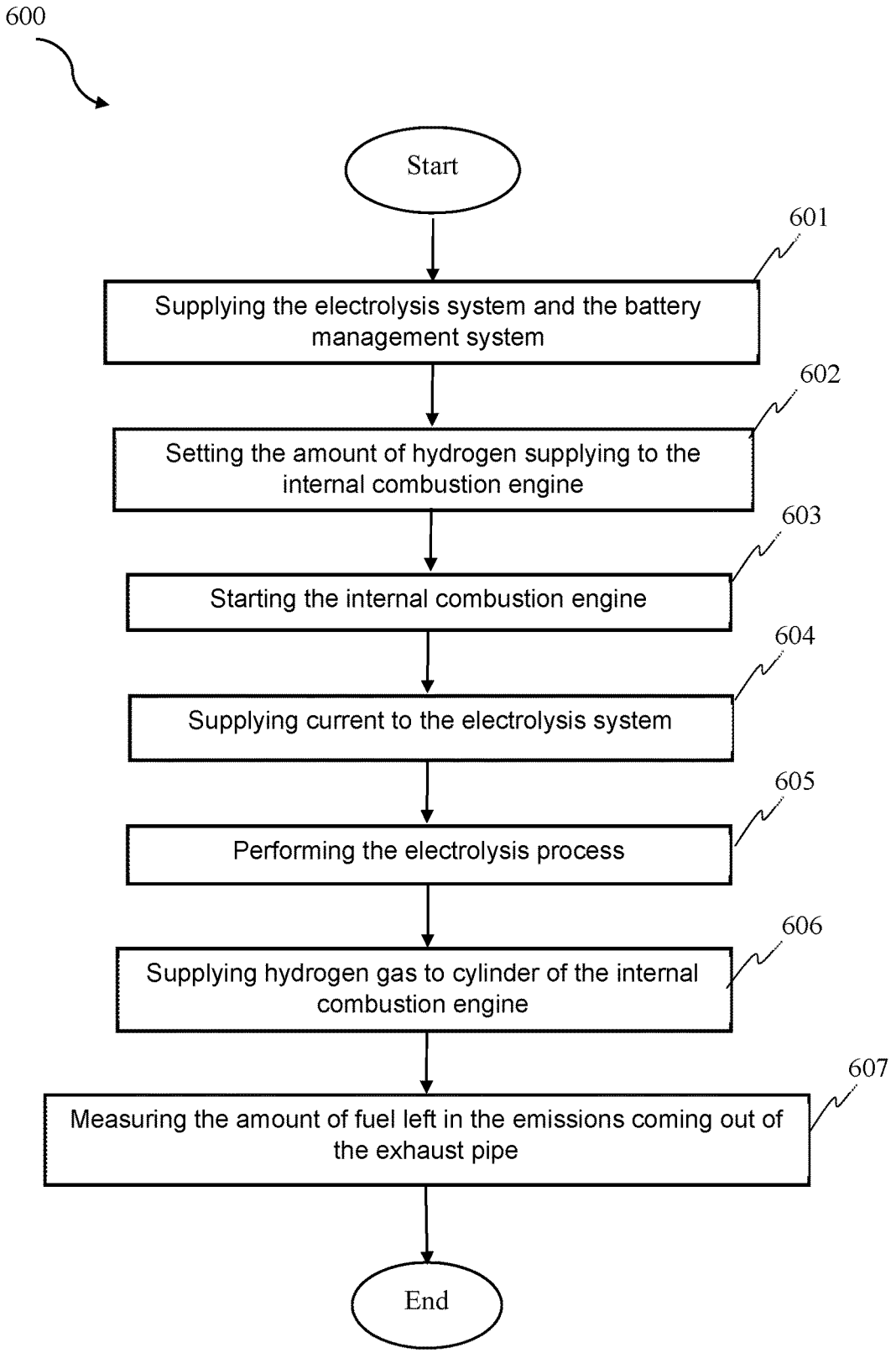
FIG. 6 illustrating a method for producing hydrogen gas to supply internal combustion engines.

Referring to FIG. 6, a flowchart illustrating a method for producing hydrogen gas to supply internal combustion engines 600 ("method 600") according to the invention. The method 600 begins with step 601, supplying the electrolysis system 130 and the battery management system 260, and then connecting them to the rest of the hydrogen gas generation system to supply internal combustion engines 200.

At step 602, the operator sets the amount of hydrogen supplied to the internal combustion engine 220 through the screen 211. Then, based on this setting, the electrolysis system 130 will be controlled to deliver an optimal amount of hydrogen gas to the internal combustion engine 220.

At step 603, starting the internal combustion engine 220. The controller 210 controls the electric system of transportation vehicle 230 to supply the current to the internal combustion engine 220, and at the same time controls the fuel supply unit 240 to inject the fuel into the cylinder 310, air will also be introduced to the cylinder 310 through the intake manifold 320. The mixture of the fuel and the air will be burned in the cylinder 310 to generate work.

At step 604, supplying current to the electrolysis system 130. When the internal combustion engine 220 has operated, the controller 210 will control the electric system of transportation vehicle 230 and/or the battery management system 260 to supply current to the first current-regulating circuit 430, the first current-regulating circuit 430 convert the direct current into alternating current by increasing the amplitude value large enough and generating the appropriate frequency to supply the metal bars 412 of the electrolysis device 410. The current supplied to the metal bars 412 to perform the electrolysis process is from 1 A to 20 A.

At step 605, performing the electrolysis process. Specifically, when the metal bars 412 are supplied with electricity, they will perform the electrolysis of the water inside the electrolysis device 410 to produce the hydrogen gas. This hydrogen gas is led through the output 413 to the bottom part 423 of the hydrogen filter device 420, then the hydrogen gas will pass through the water contained in the body part 422, where the hydrogen will be cleaned and reduce the temperature to temperature appropriate.

At step 606, supplying the clean hydrogen gas from the electrolytic system 130 to cylinder 310 of the internal combustion engine 220. The controller 210 controls for the hydrogen filter device 420 supplying a set amount of the clean hydrogen gas has installed in step 602 to the cylinder 310 of the internal combustion engine 220. The clean hydrogen gas will be mixed with the air and the fuel, and then burned to generate work.

At step 607, the exhaust sensor 250 measures the amount of fuel left in the emissions coming out of the exhaust pipe 202, then sending the results to the controller 210. From this measurement result, the controller 210 will analyze and give the appropriate control signal. Specifically, if the amount of fuel left in the emissions exceeds the preset allowable threshold, the controller 210 will issue a warning on the screen 211 for the operator to adjust the amount of the fuel supplied to the internal combustion engine 220 from the fuel supply unit 240.

During the operation of the hydrogen gas generation system to supply internal combustion engines 200, the water inside the electrolysis device 410 will be lost, so it needs to be added from the water box 203.

According to an embodiment of the present invention, when in operation, the hydrogen gas generation system to supply internal combustion engines 200 will save fuel, almost completely reduce the number of harmful emissions released into the environment, cool the internal the combustion engine 220, and clears residue inside internal combustion engine 220 that originally formed due to the excess amount of fossil fuel burning is not exhausted, so it stays inside the wall/wall of the internal combustion engine 220. On the other hand, the electrolysis system 130 only works and produces the clean hydrogen gas when the internal combustion engine 220 is in operation. When the internal combustion engine 220 stops working, the electrolysis system 130 will stop producing the clean hydrogen gas and hydrogen gas will not be stored in the system, thus ensuring safety.

Implementations of the hydrogen gas generation system to supply internal combustion engines 200 disclosed above achieve the following objectives:

The hydrogen gas generation system to supply internal combustion engines can reduce the amount of diesel or gasoline fuel supplied to vehicles by up to 40%, while helping to almost completely reduce the number of harmful emissions released into the environment.

The invention also provides an electrolysis system capable of generating large quantities of the clean hydrogen gas to supply an internal combustion engine. In addition, this system is also capable of electrolyzing distilled water to produce the clean hydrogen gas without using a catalyst.

The disclosed flowchart and block diagrams illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two consecutive blocks shown may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention.

The flow diagrams depicted herein are just one example. There may be many variations to this diagram or the steps (or operations) described therein without departing from the spirit of the invention. For instance, the steps may be performed in a differing order or steps may be added, deleted or modified. All of these variations are considered a part of the claimed invention.

These claims should be construed to maintain the proper protection for the invention first described. It will be understood that those skilled in the art, both now and in the future, may make various improvements and enhancements which fall within the scope of the claims which follow. These claims should be construed to maintain the proper protection for the invention first described.

DESCRIPTION OF NUMERALS

100 Hydrogen gas generation system
110 Applicable objects
120 Energy source
130 Electrolysis system
200 Hydrogen gas generation system to supply internal combustion engines

201 Transportation vehicle
202 Exhaust pipe
203 Water box
204 Air conditioning system
210 Controller
211 Screen
220 Internal combustion engine
230 Electric system of transportation vehicle
240 Fuel supply unit
250 Exhaust sensor
260 Battery management system
310 cylinder
320 Intake manifold
330 Exhaust line
410 Electrolysis device
411 Input
412 Metal bar
413 Output
414 Water level sensor
415 Diaphragm
420 Hydrogen filter device
421 Top part
422 Body part
423 Bottom part
430 First current-regulating circuit
510 Battery
520 Second current-regulating circuit
530 Solenoid motor
540 Generator
550 Amplifier circuit
560 Rectifier circuit

What is claimed is:

1. A system for producing hydrogen gas to supply internal combustion engine, comprising a controller, an internal combustion engine, an electric system of transportation vehicle, a fuel supply unit, an exhaust sensor, a battery management system, and an electrolysis system;

the electric system of transportation vehicle supplies current to the electrolysis system, the internal combustion engine, and other accessories of a transportation vehicle;

the fuel supply unit supplies fuel to the internal combustion engine;

the exhaust sensor is installed in the exhaust pipe of the transportation vehicle;

the battery management system supplies current to the electrolysis system to carry out the electrolysis process;

the battery management system comprising at least one battery, a second current-regulating circuit, a solenoid motor, a generator, an amplifier circuit, and a rectifier circuit;

the battery supplies a direct current to the second current-regulating circuit;

the second current-regulating circuit is connected to the battery, converts the direct current into alternating current by increasing the amplitude value and generating the frequency with a predetermined value;

the second current-regulating circuit provide the alternating current that rotates the solenoid motor to generate electromagnetic induction; by the effect of the electromagnetic field, the generator is activated and generate a constant voltage alternating current;

the amplifier circuit is connected to the generator, increases the amplitude of voltage, power and amperage of the alternating current;

the rectifier circuit is connected to the amplifier circuit, converts the alternating current into a direct current to supply the electrolysis system, other components of the transportation vehicle, and the battery;

the electrolysis system is supplied with electricity from the electric system of transportation vehicle or/and a battery management system to perform the electrolysis process, generating the clean hydrogen gas for the internal combustion engine of the transportation vehicle;

the electrolysis system comprising an electrolysis device, a hydrogen filter device, and a first current-regulating circuit;

the first current-regulating circuit is connected to the electric system of transportation vehicle or/and the battery management system, converts the direct current into alternating current by increasing the amplitude value and generating the frequency with a predetermined value to supply the electrolysis device;

the electrolysis device comprising an input, metal bars, an output, and diaphragms;

wherein the input is connected to a water box; the metal bars are connected to the first current-regulating circuit, made of stainless steel and supplied with amperage I from 1 A to 20 A; the output is connected to the hydrogen filter device; the diaphragm is made of graphene or composite plastic;

the hydrogen filter device increases the purity and reduce the temperature of the hydrogen gas stream; comprising a top part, body part, and bottom part;

wherein the bottom part is connected to the output of the electrolysis device, the body part contains some amount of water, and the top part is connected to the intake manifold of the internal combustion engine;

the internal combustion engine has an intake manifold collects outside air into a cylinder of the internal combustion engine; the intake manifold is also connected to the electrolysis system to receive the hydrogen gas supplied to the cylinder; an exhaust line of the internal combustion engine allows the emissions to flow from inside the cylinder to the exhaust pipe and discharged into the environment;

the controller contains control circuits controls the water box, the internal combustion engine, the electric system of transportation vehicle, the fuel supply unit, the battery management system, the exhaust sensor, the electrolysis device, the hydrogen filter device, the first current-regulating circuit, and other devices of the transportation vehicle.

2. The hydrogen gas generation system to supply internal combustion engines according to claim 1, wherein the water box is supplied with water from the air conditioning system of the transportation vehicle.

3. The hydrogen gas generation system to supply internal combustion engines according to claim 1, wherein the water used for electrolysis comprises domestic water, pure water, distilled water, deionized water.

4. The hydrogen gas generation system to supply internal combustion engine according to claim 1, further comprising a screen is connected to the controller, which displays including at least one of the amount of hydrogen gas and fuel supply to the internal combustion engine and the amount of residual fuel present in the emissions.

5. The hydrogen gas generation system to supply internal combustion engine according to claim 1, wherein the electrolysis device further comprising a water level sensor connected to the controller which determines the water level inside the electrolysis device;

when the water level inside the electrolysis device drops below the predetermined threshold, the water level sensor send a signal to the controller, then the controller will control the water box to put the water into the electrolysis device;

when the water introduced inside the electrolysis device reaches the predetermined highest threshold, the water level sensor sends a signal to the controller to control the water box to stop supplying the water for the electrolysis device.

* * * * *